US009778581B2

(12) United States Patent
Ito et al.

(10) Patent No.: US 9,778,581 B2
(45) Date of Patent: Oct. 3, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yota Ito, Mishima (JP); Takashi Anezaki, Hiratsuka (JP); Daisuke Miura, Tokyo (JP); Hirofumi Kumoi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 14/607,868

(22) Filed: Jan. 28, 2015

(65) Prior Publication Data

US 2015/0220007 A1 Aug. 6, 2015

(30) Foreign Application Priority Data

Jan. 31, 2014 (JP) ..... 2014-017770
Dec. 25, 2014 (JP) ..... 2014-262499

(51) Int. Cl.
*G03G 5/047* (2006.01)
*G03G 5/06* (2006.01)
*G03G 5/05* (2006.01)

(52) U.S. Cl.
CPC ..... *G03G 5/0614* (2013.01); *G03G 5/056* (2013.01); *G03G 5/0672* (2013.01)

(58) Field of Classification Search
CPC ..... G03G 5/056; G03G 5/0614
USPC ..... 430/59.6
See application file for complete search history.

(56) References Cited

U.S. PATENT DOCUMENTS

2003/0054274 A1* 3/2003 Mitsumori ..... G03G 5/047 430/96
2004/0101771 A1* 5/2004 Azuma ..... G03G 5/05 430/58.85
2006/0127782 A1* 6/2006 Ishida ..... G03G 5/047 430/60
2010/0196817 A1* 8/2010 Sasaki ..... G03G 9/0819 430/109.4
2012/0264046 A1* 10/2012 Onishi ..... G03G 9/09328 430/109.3
2013/0004890 A1* 1/2013 Obara ..... G03G 9/09328 430/109.3

FOREIGN PATENT DOCUMENTS

JP H04-274434 A 9/1992
JP H08-234468 A 9/1996
JP H10-39521 A 2/1998
JP 2002-265575 A 9/2002
JP 2005-250503 A 9/2005
JP 2008-203528 A 9/2008

* cited by examiner

*Primary Examiner* — Peter Vajda
(74) *Attorney, Agent, or Firm* — Canon U.S.A. Inc., IP Division

(57) ABSTRACT

An electrophotographic photosensitive member includes a hole transporting layer containing a polyester resin having a structural unit expressed by formula (1) as a hole transporting substance.

12 Claims, 1 Drawing Sheet

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present application relates to an electrophotographic photosensitive member, a process cartridge, and an electrophotographic apparatus.

Description of the Related Art

Electrophotographic photosensitive members used in process cartridges and electrophotographic apparatuses contain an organic photoconductive substance (charge generating substance). Such an electrophotographic photosensitive member is superior in productivity because the layer thereof can be easily formed by application of a coating material. In general, an electrophotographic photosensitive member includes a support and a photosensitive layer on the support.

The photosensitive layer often has a multilayer structure including a charge generating layer containing a charge generating substance, and a hole transporting layer containing a hole transporting substance on the charge generating layer.

A more long-life electrophotographic apparatus has recently been demanded. Accordingly, it is desired to enhance the durability of the electrophotographic photosensitive member against mechanical and electrical degradation.

Japanese Patent Laid-Open No. 10-39521 discloses a technique for enhancing the mechanical strength in which the binding resin used in the hole transporting layer is replaced from a polycarbonate resin to a polyester resin to suppress mechanical degradation. For increasing the lifetime, in addition, the thickness of the hole transporting layer is increased.

In the case of a hole transporting layer containing an aromatic polyester resin produced from an aromatic dicarboxylic acid and an aromatic diol, however, if the thickness thereof is increased, photo memory is liable to occur. Photo memory is a phenomenon caused by a potential difference between a portion exposed to light and an unexposed portion. When an electrophotographic photosensitive member is exposed to light, charges retain in the exposed portion and thus cause a potential difference.

In order to achieve both the enhancement of durability and the decrease of photo memory for an electrophotographic photosensitive member, a specific structure has been devised for the aromatic polyester resin. Japanese Patent Laid-Open No. 2005-250503 discloses an aromatic polyester resin whose aromatic diol portion has a specific structure. Japanese Patent Laid-Open No. 2008-203528 discloses an aromatic polyester resin whose dicarboxylic acid portion has a specific structure.

According to a study of the present inventors, however, these aromatic polyester resins were not able to reduce photo memory sufficiently in some cases. Further improvement of aromatic polyester resin is desired.

SUMMARY OF THE INVENTION

The application provides an electrophotographic photosensitive member in which photo memory is suppressed even though the hole transporting layer contains an aromatic polyester resin, and a method for manufacturing the electrophotographic photosensitive member. Also, the application provides a process cartridge and an electrophotographic apparatus each including the electrophotographic photosensitive member.

According to an aspect of the application, an electrophotographic photosensitive member includes a support, a charge generating layer on the support, and a hole transporting layer on the charge generating layer. The hole transporting layer contains a polyester resin having a structural unit expressed by the following formula (1) and a hole transporting substance.

(1)

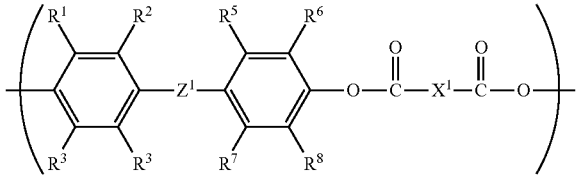

In formula (1), $R^1$ to $R^8$ each represent a hydrogen atom or a methyl group; $X^1$ represents a divalent group expressed by any one of the following formulas (2) to (5); and $Z^1$ represents a substituted cycloalkylidene group in which 1 to 3 substituent groups are alkyl groups having 1 to 3 carbon atoms. The substituted cycloalkylidene group is a 5- to 8-membered ring.

(2)

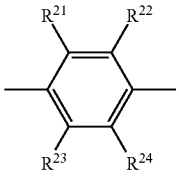

(3)

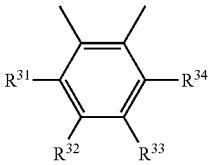

(4)

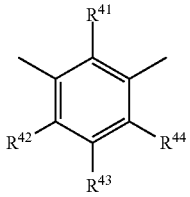

(5)

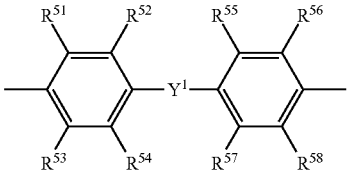

In formulas (2) to (5), $R^{21}$ to $R^{24}$, $R^{31}$ to $R^{34}$, $R^{41}$ to $R^{44}$ and $R^{51}$ to $R^{58}$ each independently represent a hydrogen atom, or a methyl group, and $Y^1$ represents a single bond, an oxygen atom, a sulfur atom, or an unsubstituted or substituted alkylene group.

According to another aspect of the present application, a process cartridge includes the electrophotographic photosensitive member and at least one device selected from the group consisting of a charging device, a developing device, and a cleaning device. The electrophotographic photosensitive member and the device are held in one body, and the process cartridge is removable from an electrophotographic apparatus.

Also, the electrophotographic apparatus includes the above-described electrophotographic photosensitive member, a charging device, an exposing device, a developing device, and a transferring device.

The electrophotographic photosensitive member, whose hole transporting layer contains a specific aromatic polyester resin, can suppress photo memory.

Further features of the present invention will become apparent from the following description of exemplary embodiments with reference to the attached drawings.

DESCRIPTION OF THE EMBODIMENTS

Figure 1:
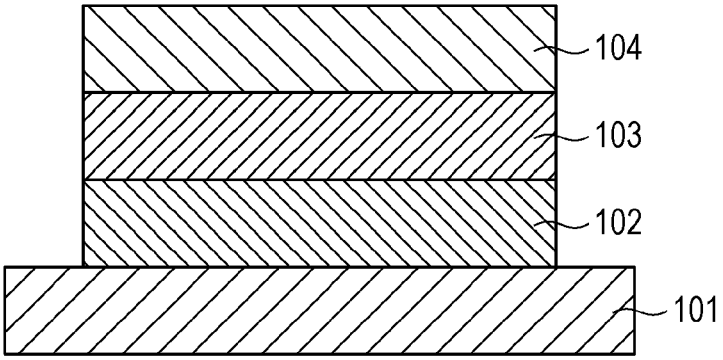
FIG. 1 is a schematic sectional view of the multilayer structure of an electrophotographic photosensitive member according to an embodiment.

The electrophotographic photosensitive member of an embodiment includes a hole transporting layer containing a polyester resin (polyarylate resin) having a structural unit expressed by the following formula (1) and a hole transporting substance.

(1)

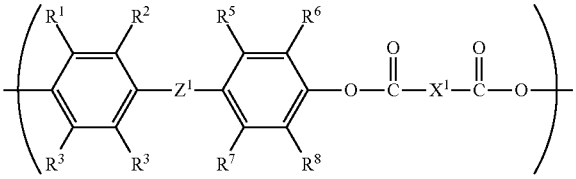

(2)

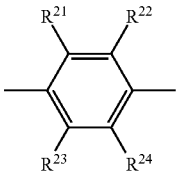

(3)

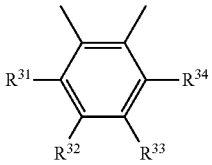

(4)

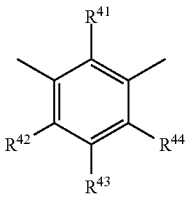

-continued (5)

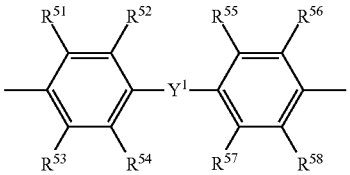

In formula (1), $R^1$ to $R^8$ each represent a hydrogen atom or a methyl group. $X^1$ represents a divalent group expressed by any one of formulas (2) to (5).

In formulas (2) to (5), $R^{21}$ to $R^{24}$, $R^{31}$ to $R^{34}$, $R^{41}$ to $R^{44}$ and $R^{51}$ to $R^{58}$ each represent a hydrogen atom or a methyl group. $Z^1$ represents a 5- to 8-membered substituted cycloalkylidene group. The substituted cycloalkylidene group has 1 to 3 alkyl groups having 1 to 3 carbon atoms as the substituent group. The alkyl groups having 1 to 3 carbons include methyl, ethyl, propyl, and isopropyl. The methyl group is advantageous. For the divalent group represented by $X^1$, formula (5) may be advantageous.

In formula (5), $Y^1$ represents a single bond, an oxygen atom, a sulfur atom, or an unsubstituted or substituted alkylene group. The substituted group of the substituted alkylene group may be alkyl, alkyl fluoride, alkoxy, or aryl. An advantageous $Y^1$ is a single bond, an oxygen atom or a sulfur atom.

The present inventors assume that the reason why photo memory is suppressed when the hole transporting layer contains a polyester resin having the structural unit expressed by formula (1) is as below.

The known aromatic polyester resin used as a binding resin in a hole transporting layer has more aromatic rings in the structural unit thereof than polycarbonate resin, and that the molecular chain thereof is rigid. Accordingly, the aromatic polyester resin is probably in a state where the structural unit thereof folds therein or among the molecules thereof, thus hindering the molecules of the hole transporting substance from entering among the aromatic polyester resin molecules. Thus, the molecules of the hole transporting substance become liable to aggregate. Consequently, the hole transporting layer becomes liable to retain holes generated from the charge generating layer, thus easily causing photo memory.

On the other hand, the polyester resin used in the present embodiment has a characteristic structure in which the alicyclic ring ($Z^1$ site of formula (1)) at the center of the bisphenol portion of the aromatic diol has 1 to 3 alkyl groups having 1 to 3 carbon atoms as substituent groups. Probably, the polyester resin having such a characteristic structure allows the $Z^1$ site in formula (1) to have a large volume to occupy a space, thereby prevent the structural unit of the polyester from folding in the polyester resin or among the molecules of the polyester resin. Thus the very small gaps are created among the polyester resin molecules, so that molecules of the hole transporting substance of a reasonable size can easily enter the gaps. Consequently, the molecules of the hole transporting substance are prevented from aggregating, and thus photo memory is reduced.

The electrophotographic photosensitive member of the present embodiment includes a support, a charge generating layer over the support, and a hole transporting layer over the charge generating layer.

FIG. 1 is a schematic sectional view of the multilayer structure of an electrophotographic photosensitive member according to an embodiment. In the structure shown in FIG.

1, an undercoat layer 102, the charge generating layer 103, and the hole transporting layer 104 are formed in that order on the support 101.

The electrophotographic photosensitive member is typically in a cylindrical form in which the charge generating layer and the hole transporting layer are disposed over the periphery of the cylindrical support, but may be in a belt form or a sheet form.

Hole Transporting Layer

The hole transporting layer contains a polyester resin having a structural unit expressed by formula (1) and a hole transporting substance.

Polyester Resin $Z^1$ in formula (1) may be a cyclohexylidene group, or 6-membered cycloalkylidene group. This is probably because 6-membered rings take the most table conformation with a low strain energy and consequently have an advantageous effect of reducing the rigidity of the molecules. If $Z^1$ is any of 3-, 4-, and 9-or-more membered cycloalkylidene groups, the structure thereof has a large strain energy, and the molecules thereof are rigid. Probably, such a structure hinders the hole transporting substance from entering among the polyester resin molecules.

In formula (1), the 1 to 3 alkyl groups having 1 to 3 carbon atoms may lie at a substitution site or substitution sites of the cycloalkylidene group such that the cycloalkylidene group has no symmetry element being a plane of symmetry passing through a carbon atom $C_z$ bound to the two aromatic rings of the polyester resin. Symmetry elements that are planes of symmetry are described in, for example, Atkins' Physical Chemistry 8th edition (e.g. pp. 427-428 in the first volume of Japanese version). The operation of transfer to a position of a mirror image symmetry with respect to a plane refers to a reflection. A plane of symmetry is a group of points defining a mirror plane a determining the reflection. For example, in the case where $Z^1$ represents an unsubstituted cyclohexylidene group, when the axial at the $C_z$ is defined as the principal axis, the planes containing the axial or equatorial at the $C_z$ are planes $\sigma_v$ of symmetry.

The above-described substitution site of the 1 to 3 alkyl groups having 1 to 3 carbon atoms is probably advantageous from the viewpoint of the degree of folding of polyester resin molecules and the compatibility of the polyester resin with the hole transporting substance. The present inventors assume that reduction of the symmetry by the substitution with 1 to 3 alkyl groups having 1 to 3 carbon atoms further hinders the structural unit of the polyester resin from folding. It is also assumed that the increase of the compatibility between the polyester resin and the hole transporting substance prevents the molecules of the hole transporting substance from aggregating and thus facilitates the formation of a thicker hole transporting layer.

Exemplary polyester resins expressed by formula (1) are shown, but not limited to, below.

(B5-2-1)

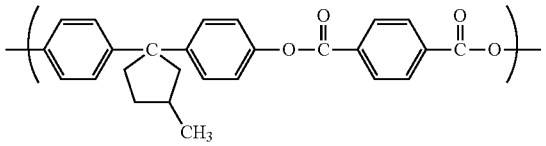

(B5-3-1)

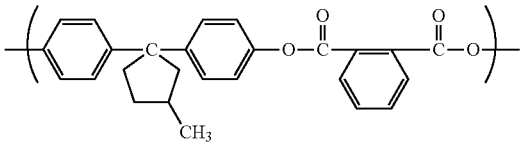

(B5-4-1)

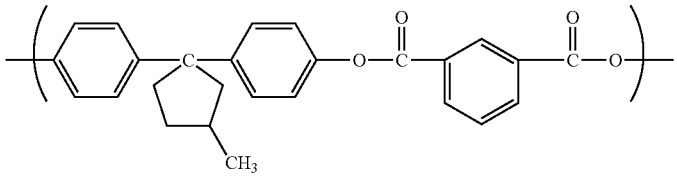

(B5-5-1)

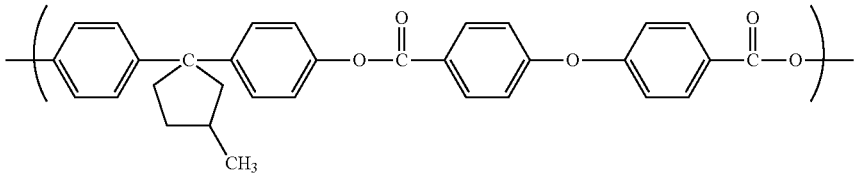

(B5-5-2)

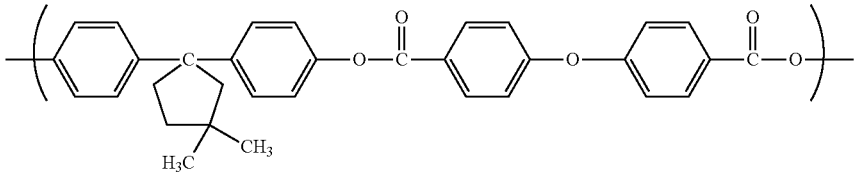

(B6-2-1)

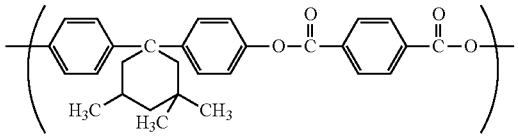

(B6-2-2)

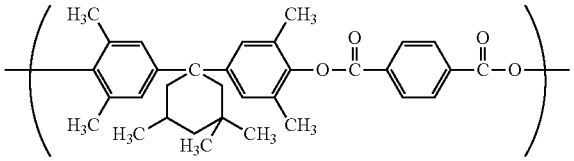

-continued
(B6-3-1)
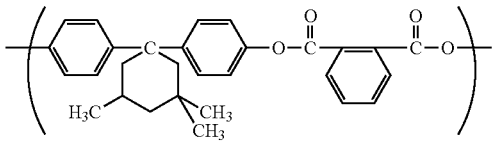
(B6-3-2)
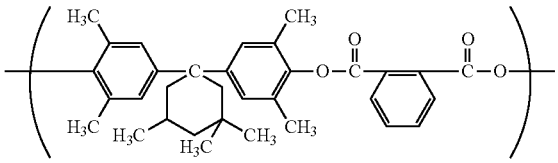
(B6-4-1)
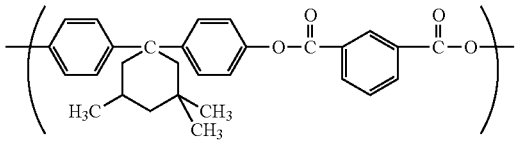
(B6-4-2)
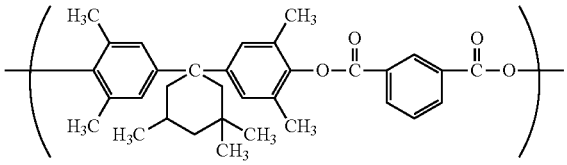
(B6-5-1)
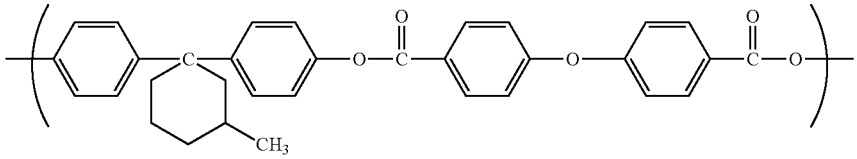
(B6-5-2)
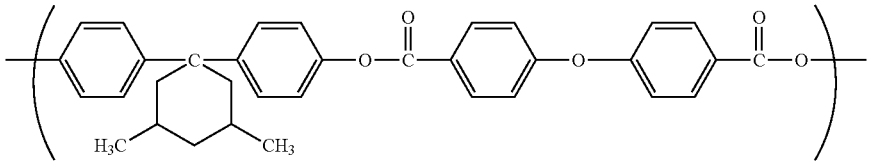
(B6-5-3)
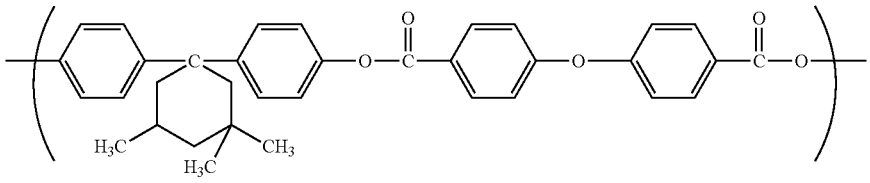
(B6-5-4)
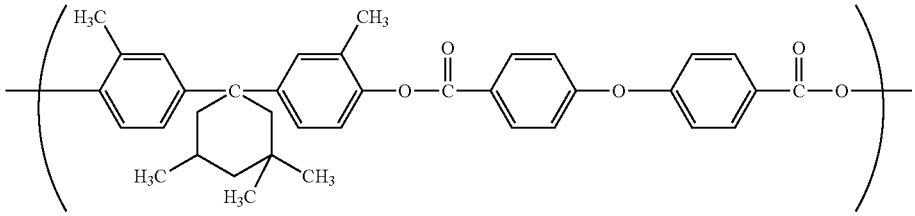
(B6-5-5)
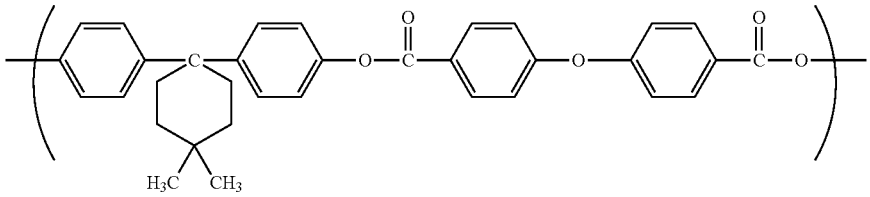
(B6-5-6)
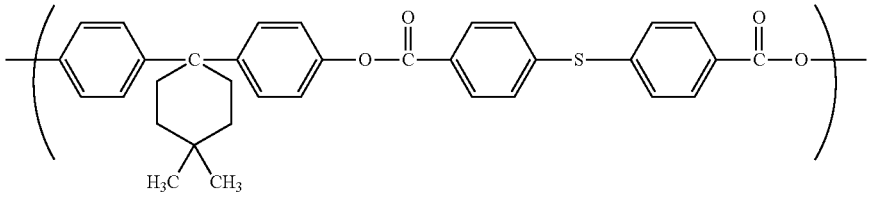

-continued
(B7-2-1)
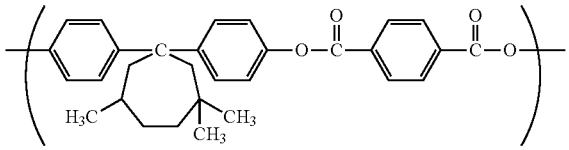
(B7-3-1)
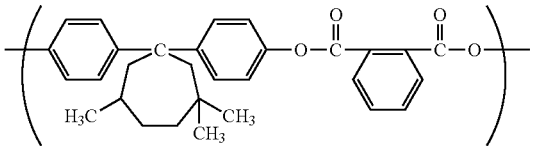
(B7-4-1)
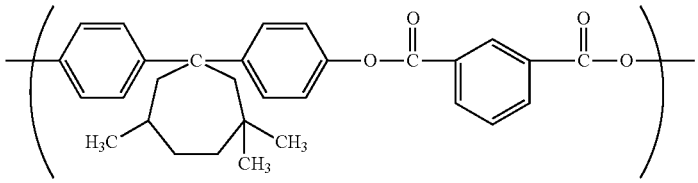
(B7-5-1)
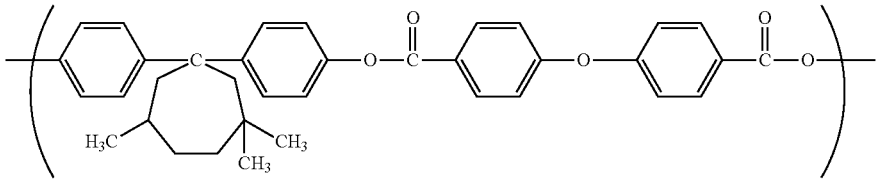
(B8-2-1)
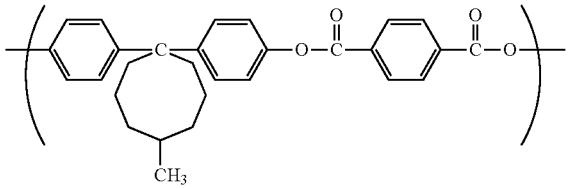
(B8-3-1)
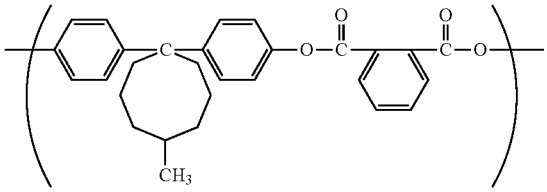
(B8-4-1)
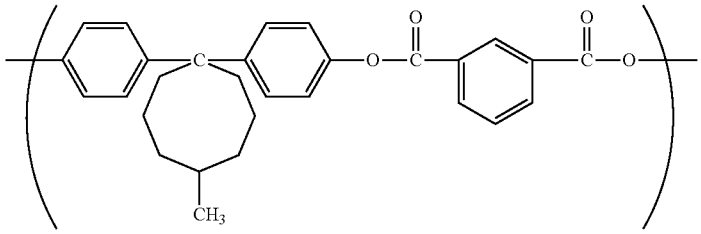
(B8-5-1)
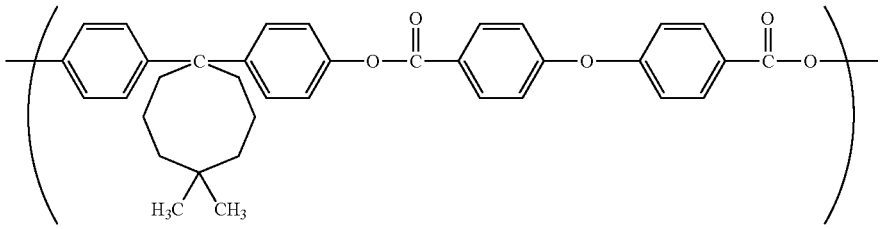

The polyester resin having a structural unit expressed by formula (1) may further have a structural unit expressed by the following formula (A):

(A)

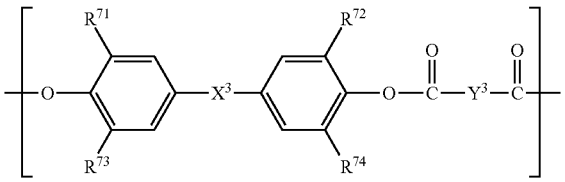

In formula A, $R^{71}$ to $R^{74}$ each represent a hydrogen atom, a methyl group, or a phenyl group. $X^3$ represents a single bond, an oxygen atom, a cyclohexylidene group, or a divalent group expressed by the following formula B: $Y^3$ represents an m-phenylene group, p-phenylene group, a cyclohexylene group, or a divalent group formed by binding two phenylene groups via an oxygen atom.

$R^{71}$ to $R^{74}$ may each be a methylene group.

(B)

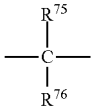

In formula B, $R^{75}$ and $R^{76}$ each represent a hydrogen atom, a methyl group, an ethyl group, or a phenyl group. Among these, a hydrogen atom and a methyl group are advantageous.

The hole transporting layer may further contain additional binding resins other than the polyester resin having the structural unit expressed by formula (1). Examples of such an additional binding resin include polyester resins having a structural unit other than the structural unit expressed by formula (1), polycarbonate resins, polymethacrylate resins, polysulfone resins, and polystyrene resins. These binding resins may be added in a proportion of 200% by mass or less relative to the polyester resin having the structural unit expressed by formula (1) from the viewpoint of producing the effects intended in the present embodiment.

These binding resins may be blended for use, or used in copolymer. The binding resins may have a weight average molecular weight of 10,000 to 300,000, such as 50,000 to 150,000.

Hole Transporting Substance

Examples of the hole transporting substance in the hole transporting layer include polycyclic aromatic compounds, heterocyclic compounds, hydrazone compounds, styryl compounds, enamines, benzidine compounds, triarylamine compounds, and triphenylamine. Alternatively, the hole transporting substance may be a polymer having a group derived from these compounds in the main chain or a side chain.

A hole transporting substance having a molecular weight in the range of 700 to 1200 can advantageously produce the effect of reducing photo memory. This is suggested in Examples 1 to 18 described later, in which Examples 11 to 18 using hole transporting substances having molecular weights in the range of 700 to 1200 exhibited larger decreases in photo memory than Examples 1 to 10 using hole transporting substances having molecular weight of less than 700. Probably, a hole transporting substance having a molecular weight in that range can appropriately enter the inside of the polyester resin molecule or among the molecules of the polyester resin, thereby enhancing the effect of reducing photo memory. Hole transporting substances having molecular weights in the range of 700 to 1000 are more advantageous.

The hole transporting substance having a molecular weight in the range of 700 to 1200 may be a compound expressed by the following formula (S1) or (S2) from the viewpoint of reducing photo memory.

(S1)

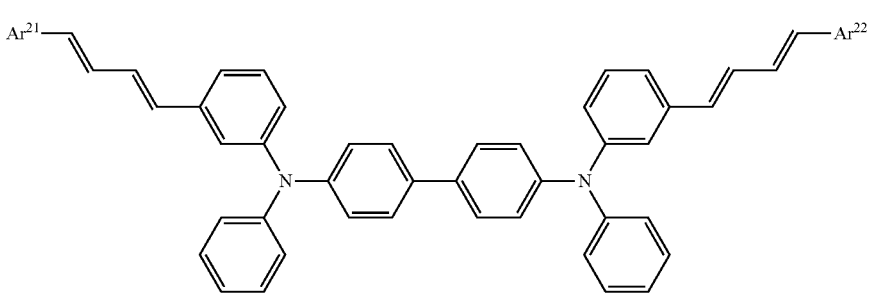

In formula S1, $Ar^{21}$ and $Ar^{22}$ each represent a phenyl group or a methyl-substituted phenyl group.

(S2)

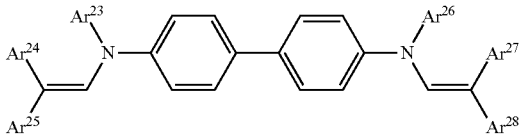

In formula S2, $Ar^{23}$ to $Ar^{28}$ each represent a phenyl group or a methyl-substituted phenyl group.

In the hole transporting layer, the mass ratio of the hole transporting substance to the binding resins may be in the range of 10/5 to 5/10, such as 10/8 to 6/10. The thickness of the hole transporting layer may be in the range of 5 m to 40 μm.

The solvent used in the coating liquid used for forming the hole transporting layer may be an alcohol-based solvent, a sulfoxide-based solvent, a ketone-based solvent, an ether-based solvent, an ester-based solvent, or an aromatic hydrocarbon.

The content of the diol compound expressed by the following formula (6) in the polyester resin having the structural unit expressed by formula (1) is desirably 100 ppm or less. In this case, the decreased in charge transporting power can be suppressed, and thus the occurrence of photo memory can be further suppressed.

(1)

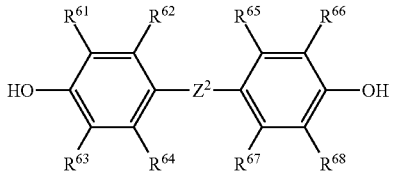

In formula (6), $R^{61}$ to $R^{68}$ each represent a hydrogen atom, a methyl group, or an aryl group. $Z^2$ represents a substituted 5- to 8-membered cycloalkylidene group, and the substituted cycloalkylidene group has 1 to 3 alkyl groups having 1 to 3 carbon atoms as the substituent group.

More desirably, the aromatic dicarboxylic acid content in the polyester resin is 50 ppm or less. In this case, the stability of electrical characteristics can be satisfactorily maintained.

If the contents (amount of residue) of the diol compound expressed by formula (6) and the aromatic dicarboxylic acid are large, the residue can be removed. The removal of the residue may be performed by cleaning with water or ion-exchanged water. For higher cleaning effect, the water or ion exchanged water may be heated. If the water or ion exchanged water is heated, however, the heating temperature is desirably in the range of 30° C. to 80° C., such as 50° C. or less, from the viewpoint of preventing the resin from decomposing.

The hole transporting layer may be provided thereon with a protective layer (surface protection layer) containing a binding resin and conductive particles or a hole transporting substance. The protective layer may further contain an additive such as a lubricant. The binding resin in the protective layer may have electrical conductivity or hole transporting ability. In this instance, the protective layer need not contain conductive particles, a hole transporting substance or materials other than the binding resin. The binding resin in the protective layer may be thermoplastic, or may be a resin cured by heat, light, or radiation (e.g. electron beam).

Each layer of the electrophotographic photosensitive member, such as a conductive layer, the undercoat layer, the charge generating layer, and the hole transporting layer, may be formed by the following process. For example, the material of each layer is dissolved and/or dispersed in a solvent to prepare a coating liquid. The coating liquid is applied to form a coating film, and the coating film is dried and/or cured. The coating liquid may be applied by immersion (immersion coating), spray coating, curtain coating, spin coating, or a ring method. From the viewpoint of efficiency and productivity, immersion coating is advantageous.

Support

The support is desirably electrically conductive (conductive support), and may be made of a metal, such as aluminum, iron, nickel, copper, or gold, or an alloy thereof. Alternatively, an insulating support made of, for example, polyester resin, a polycarbonate resin, a polyimide resin or glass may be coated with a metal thin film made of, for example, aluminum, chromium, silver or gold. The insulating support may be coated with a conductive thin film made of, for example, indium oxide, tin oxide or zinc oxide, or a conductive ink containing silver nanowires.

The support may be subjected to surface treatment to improve the electrical characteristics and suppress the occurrence of interference fringes by electrochemical operation such as anodization, or wet honing, blast or cutting.

Conductive Layer

A conductive layer may be provided between the support and the undercoat layer. The conductive layer can be formed by applying a coating liquid for forming the conductive layer containing conductive particles dispersed in a binding resin to the surface of the support, and drying the coating film on the support. Examples of the conductive particles include metal powders such as that of carbon black, acetylene black, aluminum, iron, nickel, copper, zinc or silver, and metal oxide powder such as that of conductive zinc oxide, tin oxide or ITO.

The binding resin used in the conductive layer may be a polyester resin, a polycarbonate resin, a polyvinyl butyral resin, an acrylic resin, a silicone resin, an epoxy resin, a melamine resin, a urethane resin, a phenol resin, or an alkyd resin.

The solvent used in the coating liquid for the conductive layer may be an ether-based solvent, an alcohol-based solvent, a ketone-based solvent, or an aromatic hydrocarbon. The thickness of the conductive layer may be in the range of 0.2 μm to 40 μm, such as 1 μm to 35 μm or 5 μm to 30 μm.

Undercoat Layer

The undercoat layer is optionally disposed on the support or between the conductive layer and the charge generating layer. The undercoat layer can be formed by applying a coating liquid for forming the undercoat layer containing a binding resin, and drying the coating.

Examples of the binding resin in the undercoat layer include polyacrylic acid-based resin, methyl cellulose, ethyl cellulose, polyamide resin, polyimide resin, poly(amide-imide) resin, polyamide acid resin, urethane resin, melamine resin, and epoxy resin. Alternatively, the binding resin may be a polymer having a cross-linked structure formed by thermally polymerizing (curing) a thermosetting resin having a polymerizable functional group, such as acetal resin or alkyd resin, and a monomer having a polymerizable functional group, such as isocyanate.

The thickness of the undercoat layer may be in the range of 0.05 μm to 40 μm, such as 0.05 μm to 7 μm or 0.1 μm to 2 μm.

In order to prevent the retention of charges generated from the charge generating layer, an electron transporting substance or a semi-conductive substance may be added to the undercoat layer.

Charge Generating Layer

The charge generating layer is disposed on the support, the conductive layer or the undercoat layer. The charge generating layer contains a charge generating substance. Examples of the charge generating substance include azo pigments, perylene pigments, anthraquinone derivatives, anthanthrone derivatives, dibenzpyrenequinone derivatives, pyranthrone derivatives, violanthrone derivatives, isoviolanthrone derivatives, indigo derivatives, thioindigo derivatives, phthalocyanine pigments, and bisbenzimidazole derivatives. Among these, azo pigments and phthalocyanine pigments are advantageous. Advantageous phthalocyanine pigments include oxytitanium phthalocyanine, chlorogallium phthalocyanine, and hydroxygallium phthalocyanine.

The charge generating layer also contains a binding resin. Examples of the binding resin include polymers or copolymers of vinyl compounds, such as styrene, vinyl acetate, vinyl chloride, acrylic esters, methacrylic esters, vinylidene fluoride, and trifluoroethylene; and polyvinyl alcohol resin, polyvinyl acetal resin, polycarbonate resin, polyester resin, polysulfone resin, polyphenylene oxide resin, polyurethane resin, cellulose resin, phenol resin, melamine resin, silicone resin, and epoxy resin. Among these, polyester resin, polycarbonate resin, and polyvinyl acetal resin are advantageous. Polyvinyl acetal resin is particularly advantageous.

In the charge generating layer, the mass ratio of the charge generating substance to the binding resin may be in the range of 10/1 to 1/10, such as 5/1 to 1/5. The thickness of the charge generating layer may be in the range of 0.05 μm to 5 μm. The solvent used in the coating liquid for the charge generating layer may be an alcohol-based solvent, a sulfoxide-based solvent, a ketone-based solvent, an ether-based solvent, an ester-based solvent, or an aromatic hydrocarbon.

Process Cartridge and Electrophotographic Apparatus

Figure 2:
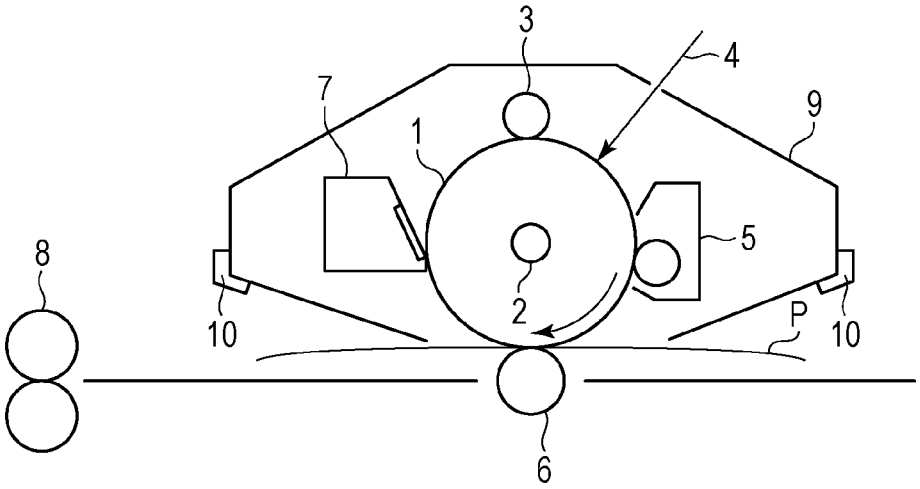
FIG. 2 is a schematic view of the structure of an electrophotographic apparatus provided with a process cartridge including the electrophotographic photosensitive member.

FIG. 2 is a schematic view of the structure of an electrophotographic apparatus provided with a process cartridge including an electrophotographic photosensitive member. The electrophotographic photosensitive member 1 is driven for rotation on an axis 2 in the direction designated by an arrow at a predetermined peripheral speed. The surface (periphery) of the electrophotographic photosensitive member 1 driven for rotation is uniformly charged to a predetermined positive or negative potential with a charging device 3 (primary charging device such as charging roller). Then, the surface or periphery is subjected to exposure (image exposure) 4 from an exposure device (not shown), such as slit exposure or laser beam scanning exposure. Thus electrostatic latent images corresponding to desired images are formed one after another on the surface of the electrophotographic photosensitive member 1.

The electrostatic latent images formed on the surface of the electrophotographic photosensitive member 1 are then developed into toner images with the toner contained in the developer of the developing device 5. Subsequently, the toner images on the surface of the electrophotographic photosensitive member 1 are transferred to a transfer medium P, such as a paper sheet, one after another from a transferring device 6, such as a transfer roller. The toner images on the surface of the electrophotographic photosensitive member 1 may be transferred in two steps, once to an intermediate transfer medium and then to the transfer medium such as a paper sheet. The transfer medium P is fed to an abutting portion between the electrophotographic photosensitive member 1 and the transferring device 6 from a transfer medium feeder (not shown) in synchronization with the rotation of the electrophotographic photosensitive member 1.

The transfer medium P to which the toner images have been transferred is separated from the surface of the electrophotographic photosensitive member 1 and introduced into a fixing device 8, in which the toner images are fixed, thus being ejected as an image-formed article (printed material or copy).

The surface of the electrophotographic photosensitive member 1 after the toner images have been transferred is cleaned with a cleaning device 7, such as a cleaning blade, to remove therefrom the developer (toner) remaining after transfer. Subsequently, the electrophotographic photosensitive member 1 is subjected to pre-exposure (not shown) with the exposure device (not shown) to remove static electricity before being reused to form images. If the charging device 3 is a type of contact charging, such as a charging roller as shown in FIG. 2, however, pre-exposure is not necessarily required.

Some of the components of the electrophotographic apparatus including the electrophotographic photosensitive member 1, the charging device 3, the developing device 5, the transferring device 6, and the cleaning device 7 may be combined in a single container as an integrated process cartridge. The process cartridge may be removably mounted to an electrophotographic apparatus such as a copy machine or a laser beam printer. In the embodiment shown in FIG. 2, the electrophotographic photosensitive member 1, the charging device 3, the developing device 5 and the cleaning device 7 are integrated into a cartridge. The cartridge is guided by a guide 10 such as a rail, thus being removably used as a process cartridge 9 in the electrophotographic apparatus.

Toner

The particles of the toner used in a process cartridge and an electrophotographic apparatus, each including the electrophotographic photosensitive member of an embodiment of the application may be nearly spherical. More specifically, the toner particles may have an average circularity in the range of 0.93 to 1.00, such as 0.95 to 0.99. Toner particles having such a circularity can prevent the polyester resin from being mechanically degraded, and allow the toner to be easily cleaned off.

The toner particles may have a volume average particle size of 3 μm to 10 μm, such as 5 μm to 8 μm. Also, the quotient of the volume average particle size of the toner divided by the number average particle size thereof may be in the range of 1.0 to 1.3, such as 1.0 to 1.2. Such toner particles help reduce the adverse effect of photo memory of the electrophotographic photosensitive member on image quality.

EXAMPLES

The application will be further described in detail with reference to Examples, but is not limited to the examples. The term "part(s)" used hereinafter refers to "part(s) by mass".

Example 1

An aluminum cylinder of 260.5 mm in length and 30 mm in diameter (JIS-A3003, aluminum alloy) was used as a support (conductive support).

Then, 214 parts of oxygen-deficient tin oxide-coated titanium oxide particles (metal oxide particles), 132 parts of a phenol resin (product name: Plyophen J-325, manufactured by DIC, resin solid content: 60% by mass) and 98 parts of 1-methoxy-2-propanol were added into a sand mill containing 450 parts of glass beads of 0.8 mm in diameter, and were dispersed in each other to yield a dispersion liquid at a rotation speed of 2000 rpm with cooling water set to 18° C. for 4.5 hours. After the dispersion, the glass beads were removed from the dispersion liquid through a mesh (openings: 150 μm). Silicone resin particles (product name: Tospearl 120, manufactured by Momentive Performance Materials, average particle size: 2 μm) were added to the dispersion liquid, from which the glass beads had been removed, in a proportion of 10% by mass relative to the total mass of the metal oxide particles and the binding resin in the dispersion liquid. Also, a silicone oil (product code:

SH28PA, manufactured by Dow Corning Toray) was added to the dispersion liquid in a proportion of 0.01% by mass relative to the total mass of the metal oxide particles and the binding resin in the dispersion liquid, and the mixture was stirred to yield a coating liquid for forming a conductive layer. This coating liquid was applied to the surface of the support by immersion. The resulting coating film was dried at 150° C. for 30 minutes to yield a 30 μm thick conductive layer.

Subsequently, 15 parts of N-methoxymethylated 6-nylon resin (product name: Tresin EF-30T, produced by Nagase Chemtex) and 5 parts of a copolyerized nylon resin (product name: Amilan CM8000, produced by Toray) were dissolved in a mixed solution of 220 parts of methanol and 110 parts of 1-butanol to yield a coating liquid for forming an undercoat layer. This coating liquid was applied to the surface of the conductive layer by immersion. The resulting coating film was dried at 100° C. for 10 minutes to yield a 0.65 μm thick undercoat layer.

Subsequently, Y-type oxytitanium phthalocyanine crystals (charge generating substance) whose CuKα X-ray diffraction spectrum has a peak at a Bragg angle 2θ of 27.3° +0.2° were prepared. Into a sand mill containing glass beads of 1 mm in diameter were added 10 parts of the Y-type oxytitanium phthalocyanine crystals, 5 parts of a butyral resin (product name: S-LEC BX-1, produced by Sekisui Chemical) and 260 parts of cyclohexanone. The materials were dispersed in each other for 1.5 hours to yield a dispersion liquid. Then, 240 parts of ethyl acetate was added to the dispersion liquid to yield a coating liquid for forming a charge generating layer. This coating liquid was applied to the surface of the undercoat layer by immersion. The resulting coating film was dried at 80° C. for 10 minutes to yield a 0.20 μm thick charge generating layer.

Subsequently, 17 parts of an amine compound (hole transporting substance, molecular weight: 390) expressed by the following formula (7), 20 parts of a polyester resin (weight average molecular weight: 90,000) having the structural unit expressed by formula (B6-2-1) and the structural unit expressed by formula (B6-4-1) in a proportion of 5/5 (on a mole basis), 2 parts of a hindered phenol-based antioxidant (product name: IRGANOX 1076, produced by BASF), and 0.02 part of dimethyl silicone oil (product name: KF96, produced by Shin-Etsu Chemical) were dissolved in a mixed solution of 75 parts of tetrahydrofuran and 75 parts of xylene to yield a coating liquid for forming a hole transporting layer. This coating liquid was applied to the surface of the charge generating layer by immersion. The resulting coating film was dried at 125° C. for 60 minutes to yield a 25 μm thick hole transporting layer.

The content of diol compounds expressed by formula (6) in the polyester resin having the structural units expressed by formulas (B6-2-1) and (B6-4-1) was measured as below. The polyester resin was immersed in acetonitrile for 10 minutes to prepare a liquid containing extract from the polyester resin. The content of diol compounds in the extraction liquid was measured by gas chromatography using a previously prepared calibration curve. The measurement result showed that the polyester resin contained 50 ppm of diol compounds.

(7)

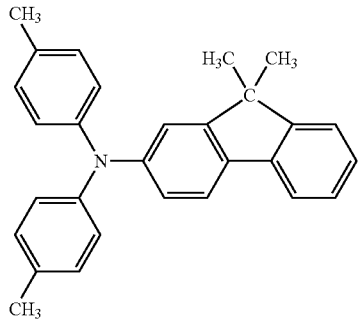

Thus, an electrophotographic photosensitive member was produced which had a conductive layer, an undercoat layer, a charge generating layer and a hole transporting layer on a support.

Estimation of Photo Memory

For estimation, a Hewlett-Packard laser beam printer (product name: HP Laser Jet Enterprise 600 M603, printing speed: 60 sheets/min for A4 portrait) was modified so that the charging potential of the electrophotographic photosensitive member and the amount of exposure from the laser beam source could be controlled. The charging potential of the electrophotographic photosensitive member was set to −600 V, and the amount of exposure from the laser beam source was set to 0.40 J/cm$^2$.

A part of the above-produced electrophotographic photosensitive member was irradiated with white light from a white fluorescent lamp of 2,000 Lux for 15 minutes and was then allowed to stand in a condition where the light was intercepted for 5 minutes, in the environment of 23° C. and 50% RH in humidity. Subsequently, the electrophotographic photosensitive member irradiated with the white light was charged at the charging potential and exposed to a laser beam at the exposure amount. Then, the surface potential of the resulting electrophotographic photosensitive member was measured at the portion irradiated with the white light and an unirradiated portion. The difference in surface potential between the irradiated portion and the unirradiated portion was used as the value $V_{PM}$ representing photo memory. In addition, the difference ($\Delta V_{PM}$) of the photo memory value in each Example from that in a Comparative Example was obtained as the decrease in photo memory.

The surface potential of the electrophotographic photosensitive member was measured as below. First, the process cartridge of the above-mentioned laser beam printer was modified by attaching a potential probe (Model 6000B-8 manufactured by Trek Japan) to the development position thereof. Then, the potential at the center of the electrophotographic photosensitive member (at the position of 130 mm from an end) was measured with a surface electrometer (Model 344, manufactured by Trek Japan). The results are shown in Table 1. The decrease in photo memory was calculated as the difference in photo memory between Comparative Example 2 and Example 1.

After the measurement of photo memory, halftone images were continuously formed. The densities of the resulting halftone images were visually compared between portions of the electrophotographic photosensitive member irradiated with white light and unirradiated portions. No difference in density was observed between the irradiated portions and the unirradiated portions.

Example 2

The photo memory was estimated in the same manner as in Example 1, except that the polyester resin was replaced with a polyester resin (weight average molecular weight: 96,000) having the structural unit expressed by formula (B6-5-3). The results are shown in Table 1. The decrease in photo memory was calculated as the difference in photo memory between Comparative Example 1 and Example 2.

Example 3

The photo memory was estimated in the same manner as in Example 1, except that 20 parts of the polyester resin of Example 1 was replaced with 10 parts of a polyester resin (weight average molecular weight: 96,000) having the structural unit expressed by formula (B6-5-3) and 10 parts of a polyester resin (weight average molecular weight: 90,000) having the structural unit expressed by formula (8). The results are shown in Table 1. The decrease in photo memory was calculated as the difference in photo memory between Comparative Example 2 and Example 3.

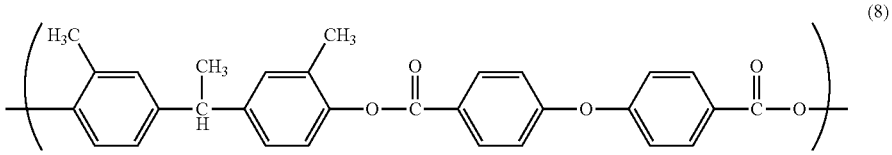

(8)

Example 4

The photo memory was estimated in the same manner as in Example 1, except that the polyester resin of Example 1 was replaced with a polyester resin (weight average molecular weight: 94,000) having the structural unit expressed by formula (B6-5-3) and the structural unit expressed by formula (8) in a proportion of 5/5 (on a mole basis). The results are shown in Table 1. The decrease in photo memory was calculated as the difference in photo memory between Comparative Example 2 and Example 4.

Example 5

The photo memory was estimated in the same manner as in Example 1, except that the polyester resin was replaced with a polyester resin (weight average molecular weight: 80,000) having the structural unit expressed by formula (B5-5-1). The results are shown in Table 1. The decrease in photo memory was calculated as the difference in photo memory between Comparative Example 1 and Example 5.

Example 6

The photo memory was estimated in the same manner as in Example 1, except that the polyester resin was replaced with a polyester resin (weight average molecular weight: 96,000) having the structural unit expressed by formula (B6-5-5). The results are shown in Table 1. The decrease in photo memory was calculated as the difference in photo memory between Comparative Example 1 and Example 6.

Example 7

The photo memory was estimated in the same manner as in Example 1, except that the polyester resin was replaced with a polyester resin (weight average molecular weight: 100,000) having the structural unit expressed by formula (B7-5-1). The results are shown in Table 1. The decrease in photo memory was calculated as the difference in photo memory between Comparative Example 1 and Example 7.

Example 8

The photo memory was estimated in the same manner as in Example 1, except that the polyester resin was replaced with a polyester resin (weight average molecular weight: 83,000) having the structural unit expressed by formula (B8-5-1). The results are shown in Table 1. The decrease in photo memory was calculated as the difference in photo memory between Comparative Example 1 and Example 8.

Comparative Example 1

The photo memory was estimated in the same manner as in Example 1, except that the polyester resin was replaced with a polyester resin (weight average molecular weight: 89,000) having the structural unit expressed by the following formula (9). The results are shown in Table 1.

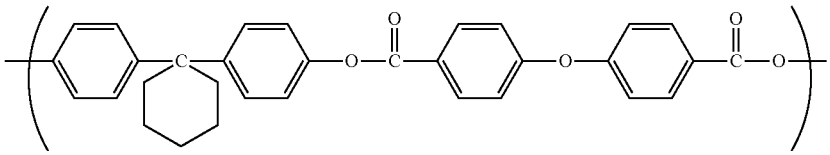

(9)

Comparative Example 2

The photo memory was estimated in the same manner as in Example 1, except that the polyester resin was replaced with a polycarbonate resin (weight average molecular weight: 60,000) having the structural unit expressed by the following formula (10) and the structural unit expressed by the following formula (11) in a proportion of 5/5 (on a mole basis). The results are shown in Table 1.

After the measurement of photo memory, halftone images were continuously formed. The densities of the resulting halftone images were visually compared between portions of the electrophotographic photosensitive member irradiated with white light and unirradiated portions. A small difference in density was observed between the irradiated portions and the unirradiated portions.

(10)

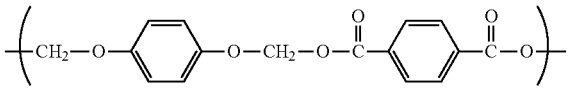

(11)

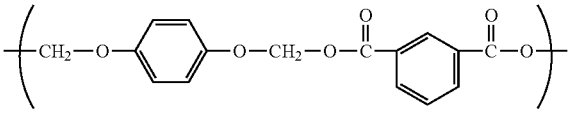

TABLE 1

| Example | Hole transporting substance: Structural formula | Molecular weight | Resin | Formula (6) content | Photo memory | Decrease in photo memory |
|---|---|---|---|---|---|---|
| 1 | Formula (7) | 390 | Formula (B6-2-1)-Formula (B6-4-1) (5/5) Copolymer | 50 ppm | 30 V | 19 V |
| 2 | Formula (7) | 390 | Formula (B6-5-3) | 50 ppm | 29 V | 17 V |
| 3 | Formula (7) | 390 | (5/5) mixture of Formula (B6-5-3) and Formula (8) | 25 ppm | 39 V | 10 V |
| 4 | Formula (7) | 390 | Formula (B6-5-3)-Formula (8) (5/5) Copolymer | 25 ppm | 36 V | 13 V |
| 5 | Formula (7) | 390 | Formula (B5-5-1) | 50 ppm | 32 V | 14 V |
| 6 | Formula (7) | 390 | Formula (B6-5-5) | 50 ppm | 33 V | 13 V |
| 7 | Formula (7) | 390 | Formula (B7-5-1) | 50 ppm | 33 V | 13 V |
| 8 | Formula (7) | 390 | Formula (B8-5-1) | 50 ppm | 34 V | 13 V |

| Comparative Example | Hole transporting substance: Structural formula | Molecular weight | Resin | Formula content | Photo memory |
|---|---|---|---|---|---|
| 1 | Formula (7) | 390 | Formula (9) | — | 46 V |
| 2 | Formula (7) | 390 | Formula (10)-Formula (11) (5/5) Copolymer | — | 49 V |

Example 9

The photo memory was estimated in the same manner as in Example 1, except that 20 parts of the polyester resin was replaced with 10 parts of a polyester resin (weight average molecular weight: 96,000) having the structural unit expressed by formula (B6-5-3) and 10 parts of a polycarbonate resin (weight average molecular weight: 53,000) having the structural unit expressed by the following formula (12). The results are shown in Table 2. The decrease in photo memory was calculated as the difference in photo memory between Comparative Example 3 and Example 9.

(12)

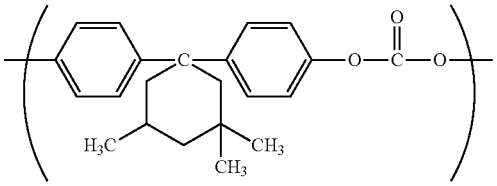

Example 10

The photo memory was estimated in the same manner as in Example 1, except that 20 parts of the polyester resin was replaced with 10 parts of a polyester resin (weight average molecular weight: 96,000) having the structural unit expressed by formula (B6-5-3) and 10 parts of a polycarbonate resin (weight average molecular weight: 47,000) having the structural unit expressed by formula (12) and the structural unit expressed by the following formula (13) in a proportion of 4/6 (on a mole basis). The results are shown in Table 2. The decrease in photo memory was calculated as the difference in photo memory between Comparative Example 3 and Example 10.

(13)

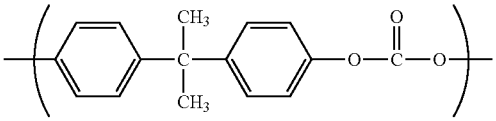

Comparative Example 9

The photo memory was estimated in the same manner as in Example 1, except that 20 parts of the polyester resin was replaced with 10 parts of a polyester resin (weight average molecular weight: 94,000) having the structural unit expressed by formula (8) and 10 parts of a polycarbonate resin (weight average molecular weight: 47,000) having the structural unit expressed by formula (12) and the structural unit expressed by formula (13) in a proportion of 4/6 (on a mole basis). The results are shown in Table 2.

TABLE 2

| | Hole transporting substance | | | | | Decrease |
|---|---|---|---|---|---|---|
| Example | Structural formula | Molecular weight | Resin | Formula (6) content | Photo memory | in photo memory |
| 9 | Formula (7) | 390 | (5/5) Mixture of Formula (B6-5-3) and Formula (12) | 50 ppm | 28 V | 13 V |
| 10 | Formula (7) | 390 | Formula (B6-5-3) and Formula (12)-Formula (13) (4/6) copolymer | 35 ppm | 25 V | 16 V |

| | Hole transporting substance | | | | |
|---|---|---|---|---|---|
| Comparative Example | Structural formula | Molecular weight | Resin | Formula (6) content | Photo memory |
| 3 | Formula (7) | 390 | Formula (8) and Formula (12)-Formula (13) ((4/6) copolymer | — | 41 V |

Examples 11 and 12

The photo memories were estimated in the same manner as in Examples 1 and 2, respectively, except that the amine compound expressed by formula (7) was replaced with an amine compound (weight average molecular weight: 721) expressed by the following formula (14). The results are shown in Table 3. The decreases in photo memory were calculated as the differences in photo memory between Comparative Example 5 and Example 11 and between Comparative Example 4 and Example 12, respectively.

(14)

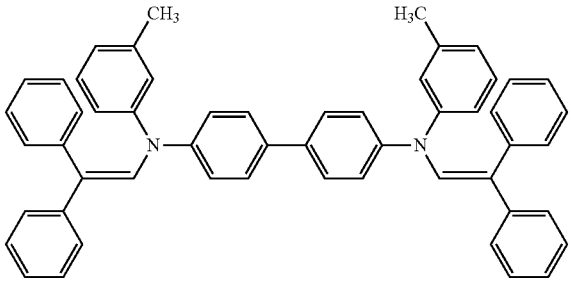

Examples 13 and 14

The photo memories were estimated in the same manner as in Examples 1 and 2, respectively, except that the amine compound expressed by formula (7) was replaced with an amine compound (weight average molecular weight: 745) expressed by the following formula (15). The results are shown in Table 3. The decreases in photo memory were calculated as the differences in photo memory between Comparative Example 5 and Example 13 and between Comparative Example 4 and Example 14, respectively.

(15)

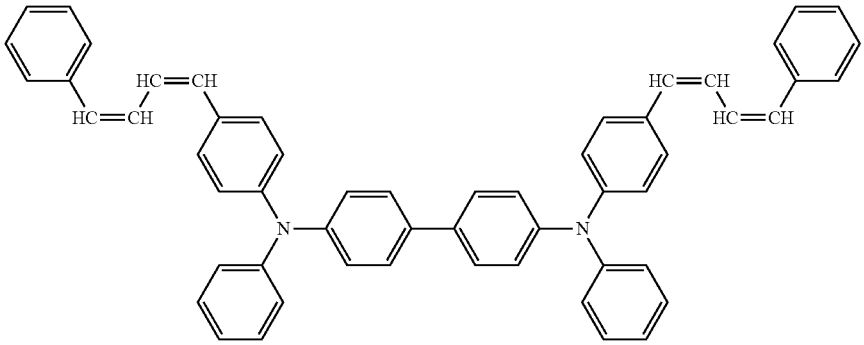

Examples 15 and 16

The photo memories were estimated in the same manner as in Examples 1 and 2, respectively, except that the amine compound expressed by formula (7) was replaced with an amine compound (weight average molecular weight: 901) expressed by the following formula (16). The results are shown in Table 3. The decreases in photo memory were calculated as the differences in photo memory between Comparative Example 5 and Example 15 and between Comparative Example 4 and Example 16.

(16)

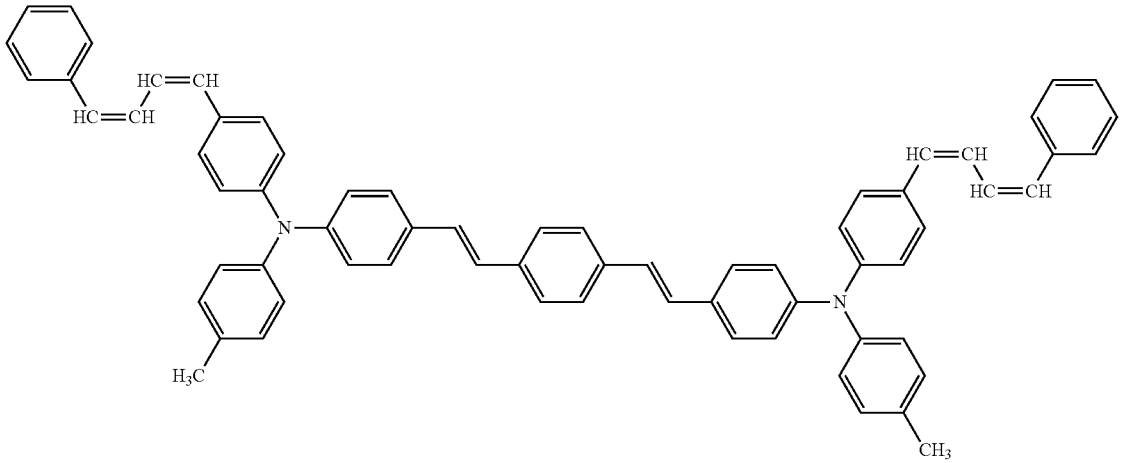

Examples 17 and 18

The photo memories were estimated in the same manner as in Examples 1 and 2, respectively, except that the amine compound expressed by formula (7) was replaced with an amine compound (molecular weight: 809) expressed by the following formula (17). The results are shown in Table 3. The decreases in photo memory were calculated as the differences in photo memory between Comparative Example 5 and Example 17 and between Comparative Example 4 and Example 18.

(17)

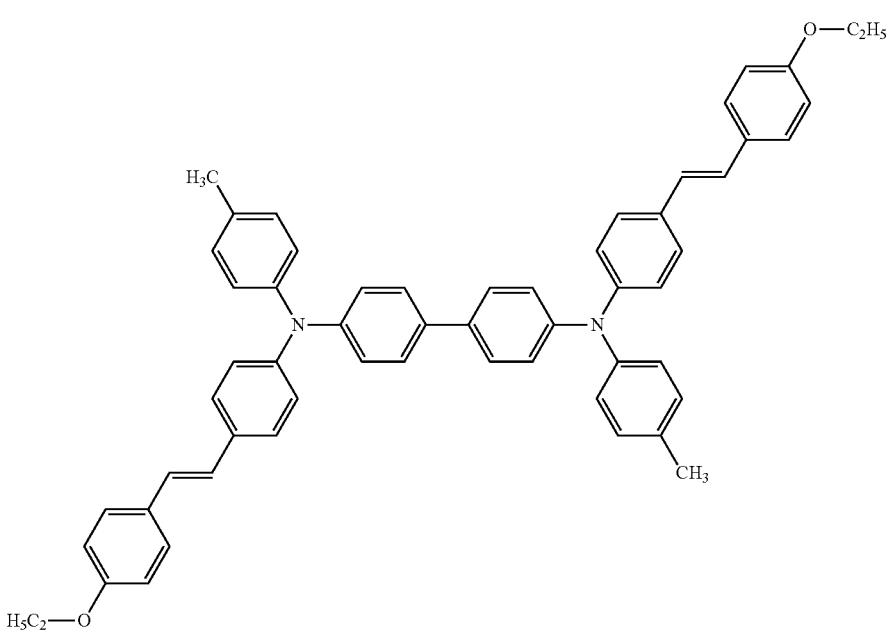

Examples 19 and 20

The electrophotographic photosensitive members were produced in the same manner as in Examples 11 and 12, respectively, except that the polyester resin was replaced with polyester resins in which the contents of the diol compound expressed by formula (6) were 95 ppm and 160 ppm, respectively. The results are shown in Table 3. The decreases in photo memory were calculated as the difference in photo memory between Comparative Example 4 and Example 19 and between Comparative Example 4 and Example 20.

Comparative Example 4

The photo memory was estimated in the same manner as in Example 12, except that the polyester resin was replaced with a polyester resin (weight average molecular weight: 94,000) having the structural unit expressed by formula (8). The results are shown in Table 3.

(18-1)

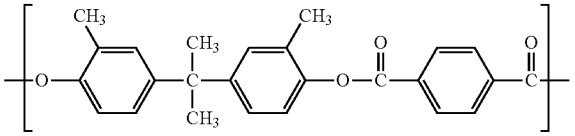

(18-2)

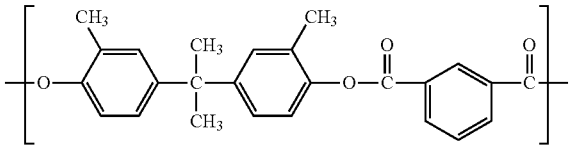

TABLE 3

| Example | Hole transporting substance: Structural formula | Hole transporting substance: Molecular weight | Hole transporting substance: Resin | Formula (6) content | Photo memory | Decrease in photo memory |
|---|---|---|---|---|---|---|
| 11 | Formula (14) | 721 | Formula (B6-2-1)-Formula (B6-4-1) (5/5) copolymer | 50 ppm | 33 V | 25 V |
| 12 | Formula (14) | 721 | Formula (B6-5-3) | 50 ppm | 32 V | 25 V |
| 13 | Formula (15) | 745 | Formula (B6-2-1)-Formula (B6-4-1) (5/5) copolymer | 50 ppm | 33 V | 25 V |
| 14 | Formula (15) | 745 | Formula (B6-5-3) | 50 ppm | 32 V | 25 V |
| 15 | Formula (16) | 901 | Formula (B6-2-1)-Formula (B6-4-1) (5/5) copolymer | 50 ppm | 36 V | 22 V |
| 16 | Formula (16) | 901 | Formula (B6-5-3) | 50 ppm | 37 V | 20 V |
| 17 | Formula (17) | 809 | Formula (B6-2-1)-Formula (B6-4-1) (5/5) copolymer | 50 ppm | 37 V | 21 V |
| 18 | Formula (17) | 809 | Formula (B6-5-3) | 50 ppm | 37 V | 20 V |
| 19 | Formula (14) | 721 | Formula (B6-5-3) | 95 ppm | 34 V | 23 V |
| 20 | Formula (14) | 721 | Formula (B6-5-3) | 160 ppm | 39 V | 18 V |

| Comparative Example | Hole transporting substance: Structural formula | Hole transporting substance: Molecular weight | Hole transporting substance: Resin | Formula (6) content | Photo memory |
|---|---|---|---|---|---|
| 4 | Formula (14) | 721 | Formula (8) | — | 57 V |
| 5 | Formula (14) | 721 | Formula (18-1)-Formula (18-2) (5/5) copolymer | — | 58 V |

Comparative Example 5

The photo memory was estimated in the same manner as in Example 11, except that the polyester resin was replaced with a polyester resin (weight average molecular weight: 100,000) having the structural unit expressed by the following formula (18-1) and the structural unit expressed by formula (18-2) in a proportion of 5/5 (on a mole basis). The results are shown in Table 3.

Example 21

The photo memory was estimated in the same manner as in Example 1, except that the Y-type oxytitanium phthalocyanine crystals in the charge generating layer was replaced with a crystalline hydroxygallium phthalocyanine whose CuKα X-ray diffraction spectrum has peaks at Bragg angles 2θ of 7.5°±0.2°, 9.9°±0.2°, 12.5°±0.2°, 16.3°±0.2°, 18.6°±0.2°, 25.1°±0.2°, and 28.3°±0.20. The results are shown in Table 4.

TABLE 4

| Example | Hole transporting substance: Structural formula | Hole transporting substance: Molecular weight | Resin | Formula (6) content | Photo memory |
|---|---|---|---|---|---|
| 21 | Formula (7) | 390 | Formula (B6-2-1)-Formula (B6-4-1) (5/5) Copolymer | 50 ppm | 18 V |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-017770, filed Jan. 31, 2014 and Japanese Patent Application No. 2014-262499, filed Dec. 25, 2014, which are hereby incorporated by reference herein in their entirety.

What is claimed is:

1. An electrophotographic photosensitive member comprising:

a support;

a charge generating layer on the support; and a hole transporting layer on the charge generating layer; wherein the hole transporting layer comprises:

binding resins comprising a polyester resin having a structural unit represented by the following formula (1); and a hole transporting substance;

(1)

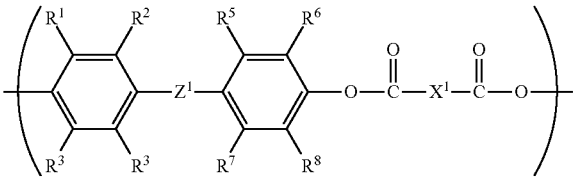

wherein, in the formula (1), $R^1$ to $R^8$ each independently represents a hydrogen atom, or a methyl group;

$X^1$ represents a divalent group represented by any one of the following formulas (2) to (5); and $Z^1$ represents a substituted cycloalkylidene group in which 1 to 3 substituent groups are alkyl groups having 1 to 3 carbon atoms, and the substituted cycloalkylidene group is a 5- to 8-membered ring, (2)

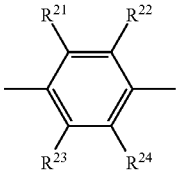

-continued (3)

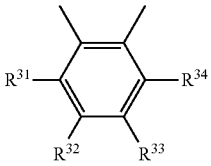

(4)

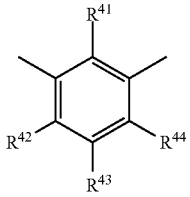

(5)

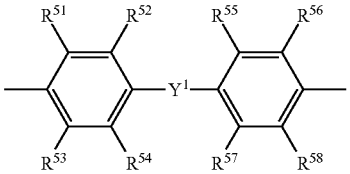

wherein, in the formulae (2) to (5), $R^{21}$ to $R^{24}$, $R^{31}$ to $R^{34}$, $R^{41}$ to $R^{44}$ and $R^{51}$ to $R^{58}$ each independently represent a hydrogen atom, or a methyl group, and $Y^1$ represents a single bond, an oxygen atom, a sulfur atom, or an unsubstituted or substituted alkylene group wherein the hole transporting substance is at least one of the compound represented by the following formula (S1):

(S1)

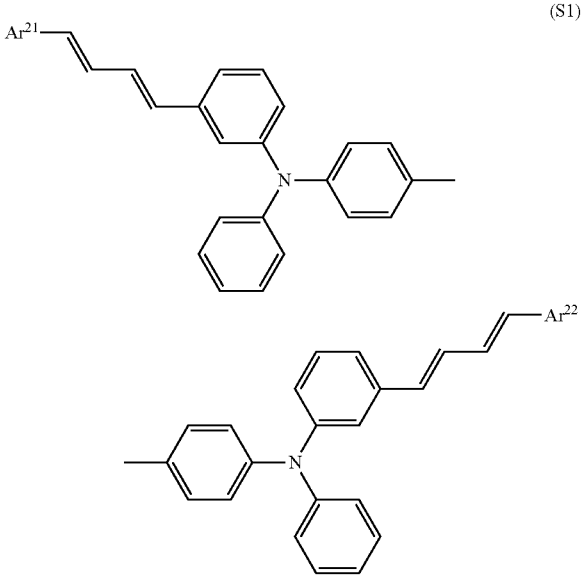

wherein $Ar^{21}$ and $Ar^{22}$ each independently represent a phenyl group or a phenyl group substituted with a methyl group; and the compound represented by the following formula (S2):

(S2)

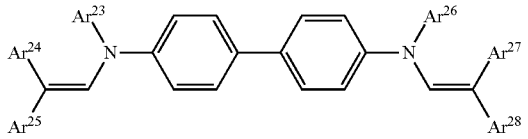

wherein $Ar^{23}$ to $Ar^{28}$ each independently represent a phenyl group or a phenyl group substituted with a methyl group, and wherein, in the hole transporting layer, the mass ratio of the hole transporting substance to the binding resins is 10/8 to 6/10.

2. The electrophotographic photosensitive member according to claim 1, wherein the hole transporting substance has a molecular weight in the range of 700 to 1200.

3. The electrophotographic photosensitive member according to claim 1, wherein $Z^1$ of formula (1) represents a substituted cyclohexylidene group.

4. The electrophotographic photosensitive member according to claim 1, wherein $X^1$ of formula (1) represents a divalent group expressed by formula (5).

5. The electrophotographic photosensitive member according to claim 1, wherein each of the 1 to 3 alkyl groups having 1 to 3 carbons lies at a substitution site or substitution sites of the cycloalkylidene group such that the cycloalkylidene group has no symmetry element being a plane of symmetry passing through a carbon atom bound to two aromatic rings of the polyester resin.

6. The electrophotographic photosensitive member according to claim 1, wherein the 1 to 3 alkyl groups having 1 to 3 carbons are 1 to 3 methyl groups.

7. The electrophotographic photosensitive member according to claim 1, wherein the polyester resin further has a structural unit represented by the following formula (A):

(A)

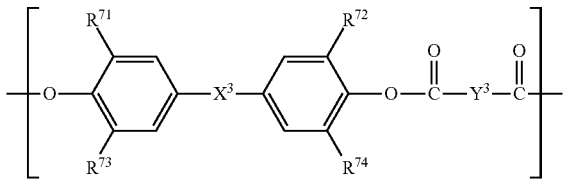

wherein $R^{71}$ to $R^{74}$ each independently represent a hydrogen atom, a methyl group, or a phenyl group; $X^3$ represents a single bond, an oxygen atom, a cyclohexylidene group, or a divalent group represented by the following formula (B); and $Y^3$ represents an m-phenylene group, p-phenylene group, a cyclohexylene group, or a divalent group formed by binding two phenylene groups via an oxygen atom:

(B)

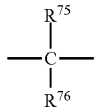

wherein $R^{75}$ and $R^{76}$ each independently represent a hydrogen atom, a methyl group, an ethyl group, or a phenyl group.

8. The electrophotographic photosensitive member according to claim 1, wherein the content of the diol compound represented by the following formula (6) in the polyester resin is 100 ppm or less:

(6)

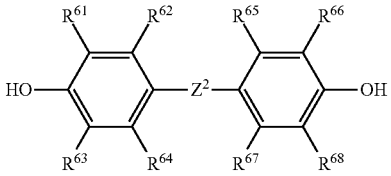

wherein $R^{61}$ to $R^{68}$ each independently represent a hydrogen atom or a methyl group, and $Z^2$ represents a substituted 5- to 8-membered cycloalkylidene group in which 1 to 3 substituent groups are alkyl groups having 1 to 3 carbon atoms.

9. A method for manufacturing the electrophotographic photosensitive member according to claim 1, the method comprising:

preparing a coating liquid for forming the hole transporting layer, the coating liquid containing the polyester resin and the hole transporting substance; and forming the hole transporting layer by applying the coating liquid to form a coating film, and drying the coating film.

10. A process cartridge comprising:

the electrophotographic photosensitive member according to claim 1; and at least one device selected from the group consisting of a charging device, a developing device, and a cleaning device, the at least one device being integrated with the electrophotographic photosensitive member in one body, wherein the process cartridge is removably mounted to an electrophotographic apparatus.

11. An electrophotographic apparatus comprising:

the electrophotographic photosensitive member as set forth in claim 1;

a charging device;

an exposure device;

a developing device; and a transferring device.

12. The electrophotographic photosensitive member according to claim 1, wherein the thickness of the hole transporting layer is 5 μm to 40 μm.

* * * * *